US009758879B1

(12) United States Patent
Skrzypchak et al.

(10) Patent No.: US 9,758,879 B1
(45) Date of Patent: Sep. 12, 2017

(54) CORROSION PREVENTION ASSEMBLY

(71) Applicant: BRP US INC., Sturtevant, WI (US)

(72) Inventors: Mark Skrzypchak, Pleasant Prairie, WI (US); Mark C. Noble, Pleasant Prairie, WI (US); David Palmer, Waukegan, IL (US); Ivan Lestan, Waterford, WI (US)

(73) Assignee: BRP US INC., Sturtevant, WI (US)

( * ) Notice: Subject to any disclaimer, the term of this patent is extended or adjusted under 35 U.S.C. 154(b) by 232 days.

(21) Appl. No.: 14/611,370

(22) Filed: Feb. 2, 2015

Related U.S. Application Data

(60) Provisional application No. 61/934,492, filed on Jan. 31, 2014.

(51) Int. Cl.
*C23F 13/02* (2006.01)
*C23F 13/20* (2006.01)
*C23F 13/18* (2006.01)

(52) U.S. Cl.
CPC ..... *C23F 13/20* (2013.01); *C23F 13/18* (2013.01); *C23F 2213/31* (2013.01)

(58) Field of Classification Search
CPC ..... C23F 13/02; C23F 13/06; C23F 13/08; C23F 13/10; C23F 13/18; C23F 13/20; C23F 2213/21; C23F 2213/30; C23F 2213/31
See application file for complete search history.

(56) References Cited

U.S. PATENT DOCUMENTS 4,280,794 A 7/1981 Goodwin
4,391,567 A 7/1983 Ciampolillo
4,486,181 A 12/1984 Cavil
4,549,949 A 10/1985 Guinn
4,604,068 A 8/1986 Guinn
4,615,684 A 10/1986 Kojima
4,872,860 A 10/1989 Meisenburg
4,932,795 A 6/1990 Guinn
4,934,952 A 6/1990 Banker
(Continued)

FOREIGN PATENT DOCUMENTS

JP WO 02055881 A1 * 7/2002 ..... F02M 59/102

OTHER PUBLICATIONS

Conversion Coating; http://en.wikipedia.org/wiki/Conversion_coating; retreived on Feb. 7, 2015.
(Continued)

*Primary Examiner* — Luan Van
*Assistant Examiner* — Alexander W Keeling
(74) *Attorney, Agent, or Firm* — BCF LLP

(57) ABSTRACT

An assembly of parts has a first metal part having a first surface having a corrosion resistant surface treatment and a second surface being free of corrosion resistant surface treatment, a second metal part having a third surface having a corrosion resistant surface treatment and a fourth surface being free of corrosion resistant surface treatment. The second metal part defines a recess that defines the fourth surface. The first and third surfaces are in contact. A conductive member is disposed at least in part in the recess and is in contact with the second and fourth surfaces. A sealing member disposed in the recess around the conductive member. A sacrificial anode is mounted and conductively connected to one of the first and second metal parts.

20 Claims, 8 Drawing Sheets

(56) References Cited

U.S. PATENT DOCUMENTS

| | | | | |
|---|---|---|---|---|
| 4,948,384 | A | 8/1990 | Bland et al. | |
| 5,011,583 | A | 4/1991 | Tanbara | |
| 5,298,794 | A | 3/1994 | Kuragaki | |
| 5,648,416 | A * | 7/1997 | Miller | C09D 5/082 524/500 |
| 5,716,248 | A | 2/1998 | Nakamura | |
| 5,803,023 | A | 9/1998 | Takahashi et al. | |
| 6,543,424 | B1 * | 4/2003 | Yamaguchi | C23C 8/80 123/495 |
| 7,121,907 | B2 | 10/2006 | Tateishi et al. | |
| 2002/0098099 | A1 * | 7/2002 | Henderson | F01C 21/0818 418/1 |
| 2011/0308967 | A1 * | 12/2011 | Byrne | C23F 13/06 205/730 |

OTHER PUBLICATIONS

Galvanic Anode; http://en.wikipedia.org/wiki/Galvanic_anode; retreived on Feb. 7, 2015.

Mercury Marine; Corrosion Protection Brochure; 2012; P/N. 90-8M0065840.

* cited by examiner

CORROSION PREVENTION ASSEMBLY

CROSS-REFERENCE

The present application claims priority to U.S. Provisional Patent Application No. 61/934,492, filed Jan. 31, 2014, the entirety of which is incorporated herein by reference.

TECHNICAL FIELD

The present technology relates to corrosion prevention assemblies.

BACKGROUND

For marine outboard engines used to propel watercraft on fresh and/or salt water, corrosion prevention has to be taken into consideration when designing the metallic parts used in their assembly.

Typically, many, if not all, the exposed surfaces of metallic parts are provided with a corrosion resistant surface treatment. This can involve both changing the physical nature of the metal's surface and/or coating it with another corrosion resistant substance. Examples of corrosion resistant surface treatments include galvanization, non-conductive paint and conversion coating such as anodization and chromate conversion coating.

Another form of corrosion prevention consists in using sacrificial anodes, typically made of zinc, magnesium or aluminum alloys. These have a more negative electrochemical potential than the aluminum or steel from which outboard engine parts are typically made. As a result, a sacrificial anode prevents oxidation on the surface of the more cathodic metal part when it is conductively connected to it. Anodes are bolted to the outboard engine in various key locations such that there is metal-to-metal contact or a conductive connection between an anode and the part it is intended to prevent from corroding. However, there are many corrodible components and it is inconvenient to attach an anode to each. As a solution, metal cables, sometimes referred to as bonding straps, ground cables or ground leads, are used to conductively connect the anodes to components with which they do not have metal-to-metal contact and to conductively connect components to other components which have metal-to-metal contact or conductive connections with anodes.

However, these metal cables can be inadvertently snagged, during maintenance for example, thereby disconnecting the metal cables and compromising the corrosion protection of the associated part. Also, the fasteners used to fasten the cables can themselves corrode. The hardware used to install the metal cables (bolts, washers, etc.) can also damage the corrosion resistant surface treatment, thereby exposing a metallic surface to potential corrosion. Similarly, during the installation of the metal cables one can inadvertently damage the corrosion resistant surface treatment with the tools used to make the installation. Also, the metal cables running from one part to the other can be considered unsightly by some.

SUMMARY

It is an object of the present technology to ameliorate at least some of the inconveniences present in the prior art.

In one aspect, implementations of the present technology provide an assembly of parts having a first metal part having a first surface having a corrosion resistant surface treatment and a second surface being free of corrosion resistant surface treatment, a second metal part having a third surface having a corrosion resistant surface treatment and a fourth surface being free of corrosion resistant surface treatment, the second metal part defining a recess, the fourth surface being a surface defined by the recess, the first surface being in contact with the third surface, a conductive member disposed at least in part in the recess between the first and second metal parts, the conductive member being in contact with the second and fourth surfaces and forming a conductive connection between the first and second metal parts, a sealing member disposed in the recess around the conductive member, the sealing member contacting the first and second metal parts, and a sacrificial anode mounted and conductively connected to one of the first and second metal parts, the sacrificial anode being conductively connected to another one of the first and second metal parts by the one of the first and second metal parts and the conductive member.

In some implementations of the present technology, the corrosion resistant surface treatment of the first metal part and the corrosion resistant surface treatment of the second metal part each include at least one of conversion coating, ceramic coating and non-conductive paint.

In some implementations of the present technology, the corrosion resistant surface treatment of the first metal part and the corrosion resistant surface treatment of the second metal part each include conversion coating. The conversion coating includes one of anodization and chromate conversion coating.

In some implementations of the present technology, the corrosion resistant surface treatment of the first metal part and the corrosion resistant surface treatment of the second metal part each include non-conductive paint disposed on top of another surface treatment. The other surface treatment being at least one of conversion coating and ceramic coating.

In some implementations of the present technology, the recess includes a hole and a counterbore. The hole having a closed end. The conductive member is disposed at least in part in the hole. The fourth surface is a surface defined by the hole. The sealing member is disposed in the counterbore.

In some implementations of the present technology, the sacrificial anode is mounted and conductively connected to the second metal part.

In some implementations of the present technology, the hole is a second hole. The first metal part defines a first hole having a closed end. The first hole is aligned with the second hole. The conductive member is disposed at least in part in the first hole. The second surface is a surface defined by the first hole.

In some implementations of the present technology, the conductive member includes a pin.

In some implementations of the present technology, the sealing member is an O-ring.

In some implementations of the present technology, the pin is hollow. The conductive member further includes a spring disposed inside the pin. The spring contacts the second and fourth surfaces.

In some implementations of the present technology, one of the first and second holes has a threaded portion adjacent the closed end of the one of the first and second holes. The spring engages the threaded portion.

In some implementations of the present technology, the pin is press-fit in the first and second holes.

In some implementations of the present technology, the conductive member is a spring.

In some implementations of the present technology, the first and second metal parts are two adjacent metal parts of a drive unit of a marine outboard engine.

In some implementations of the present technology, the two adjacent metal parts are two of a cylinder head, a cylinder block, a crankcase, an exhaust housing and a gear case assembly.

In some implementations of the present technology, the two adjacent metal parts are the exhaust housing and the gear case assembly.

In some implementations of the present technology, the first metal part is the exhaust housing, the second metal part is the gear case assembly and the sacrificial anode is mounted to and conductively connected to the gear case assembly.

For purposes of this application, terms related to spatial orientation such as forward, rearward, left, right, vertical, and horizontal are as they would normally be understood by a driver of a boat sitting thereon in a normal driving position with a marine outboard engine mounted to a transom of the boat. Also, for purposes of this application the term "conversion coating" refers to a metal surface treatment where, through a chemical or electro-chemical process, a surface of the part to which the coating is applied is converted into the coating. Examples of conversion coating include, but are not limited to, anodization, chromate conversion coating and phosphate conversion coating.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with respect to an outboard engine 10. It is contemplated that aspects of the present technology could be applied to other marine applications such as inboard engines for watercraft and stern drives. It is also contemplated that aspects of the present technology could be applied to assemblies of two or more metal parts where corrosion prevention is desired.

Figure 1:
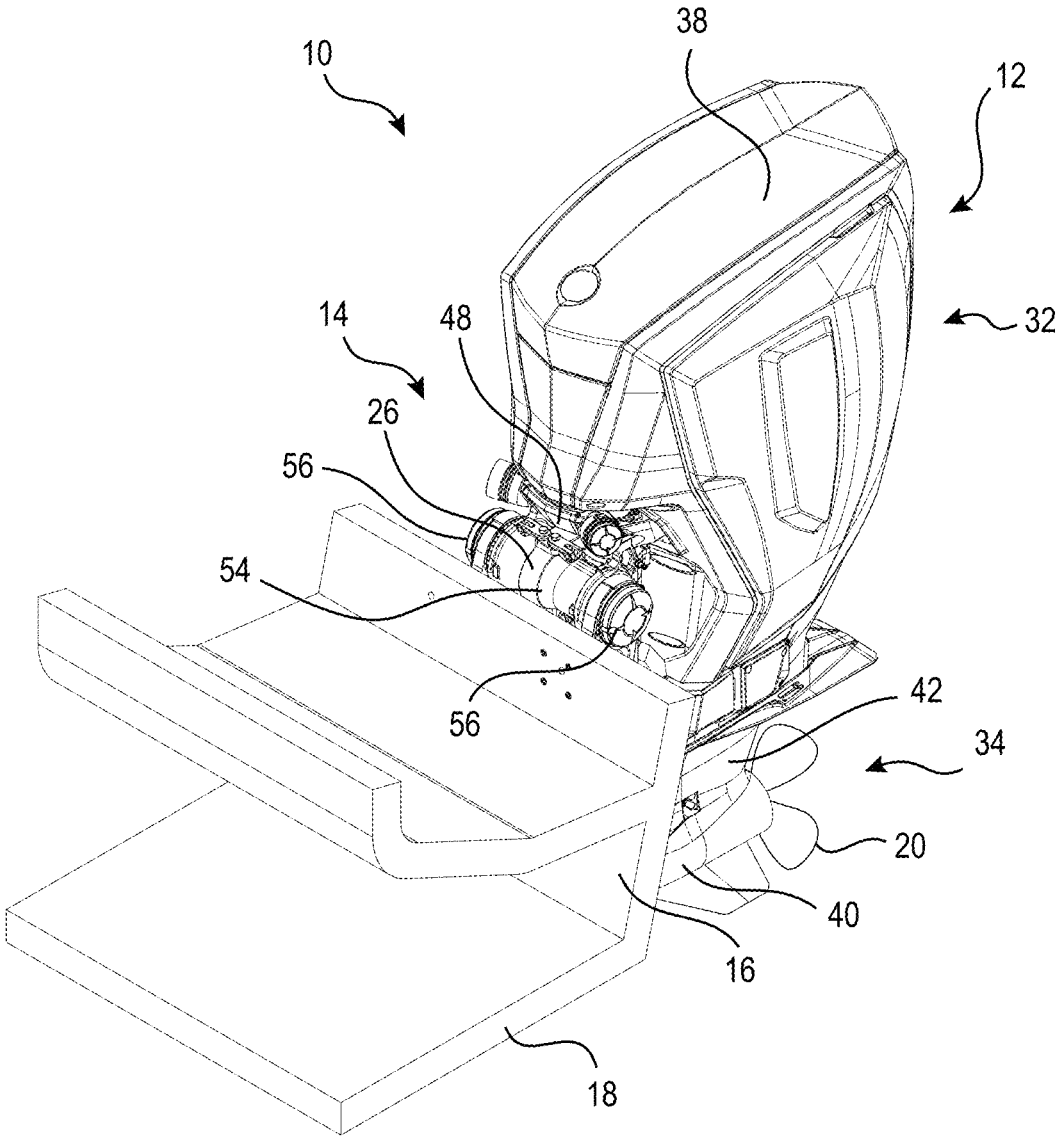
FIG. 1 is a perspective view taken from a front, left side of a marine outboard engine mounted in an upright position to a transom of watercraft.
Figure 2:
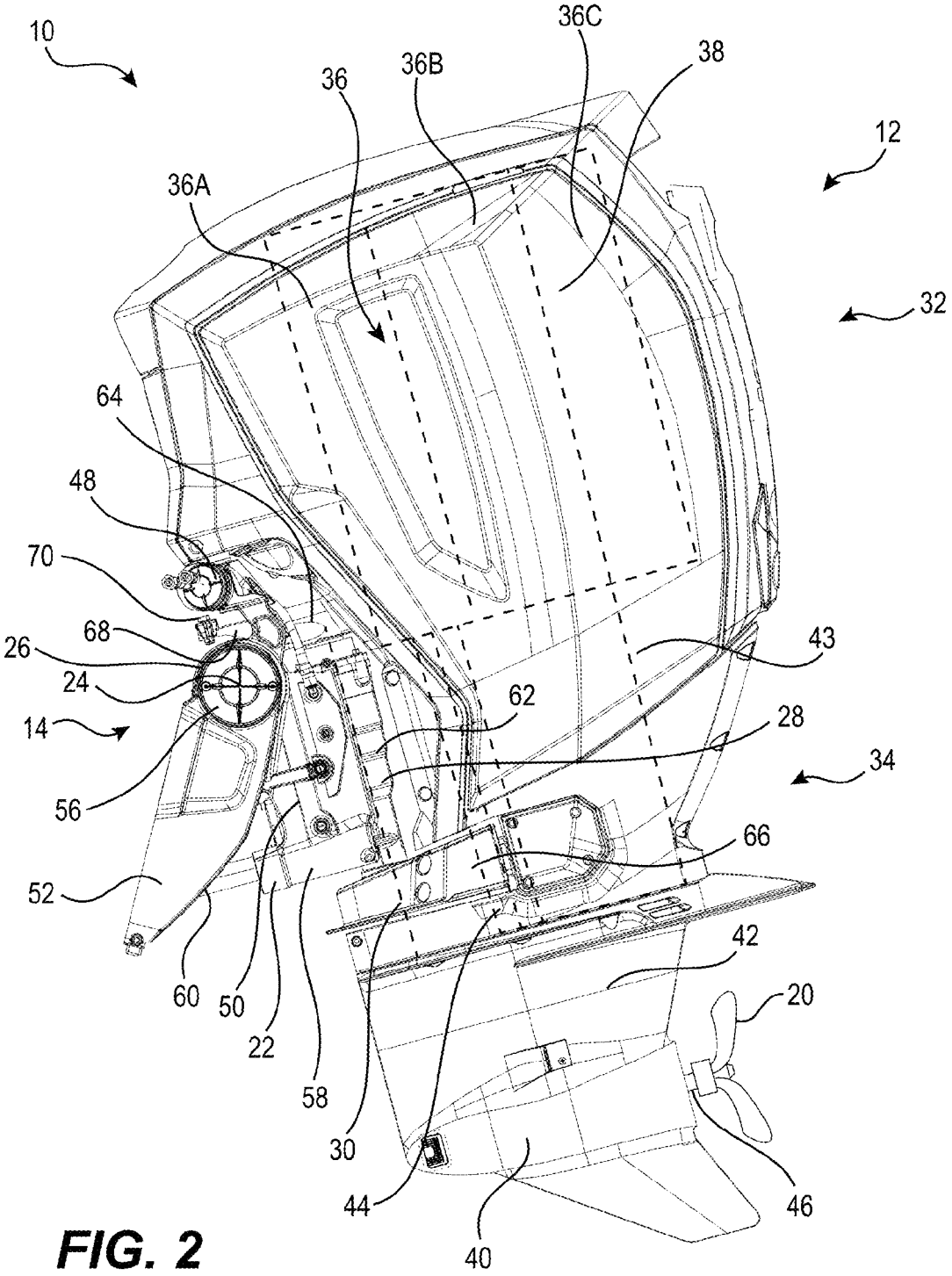
FIG. 2 is a left side elevation view of the outboard engine of FIG. 1 in a trim up position.

With reference to FIGS. 1 and 2, a marine outboard engine 10 includes a drive unit 12 and a bracket assembly 14. The bracket assembly 14 supports the drive unit 12 on a transom 16 of a hull 18 of an associated watercraft (not shown) such that a propeller 20 is in a submerged position with the watercraft resting relative to a surface of a body of water. The drive unit 12 can be trimmed up (as seen in FIG. 2) or down relative to the hull 18 by linear actuators 22 of the bracket assembly 14 about a tilt/trim axis 24 extending generally horizontally. The drive unit 12 can also be tilted up or down relative to the hull 18 by a rotary actuator 26 of the bracket assembly 14 about the tilt/trim axis 24. The drive unit 12 can also be steered left or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIG. 1, the steering axis 30 extends generally vertically. The actuators 22, 26 and 28 are hydraulic actuators. The actuators 22, 26 and 28 and their operation will be discussed in greater detail below.

The drive unit 12 includes an upper portion 32 and a lower portion 34. The upper portion 32 includes an engine 36 (schematically shown in dotted lines in FIG. 2) surrounded and protected by a cowling 38. The engine 36 housed within the cowling 38 is an internal combustion engine, such as a two-stroke or four-stroke engine, having cylinders extending horizontally. The engine 36 has a crankcase 36A, to which is mounted a cylinder block 36B and to which is mounted a cylinder head 36C. It is contemplated that other types of engine could be used and that the cylinders could be oriented differently. The lower portion 34 includes the gear case assembly 40, which includes the propeller 20, and the gear case housing 42, which extends downward from the upper portion 32. An exhaust housing 43 (schematically shown in FIG. 2) extends from the engine 36 to the gear case assembly 40.

The engine 36 is coupled to a driveshaft 44 (schematically shown in dotted lines in FIG. 2). When the drive unit 12 is in the upright position as shown in FIG. 1, the driveshaft 44 is oriented vertically. It is contemplated that the driveshaft 44 could be oriented differently relative to the engine 34. The driveshaft 44 is coupled to a drive mechanism (not shown), which includes a transmission (not shown) and the propeller 20 mounted on a propeller shaft 46. In FIG. 2, the propeller shaft 46 is perpendicular to the driveshaft 44, however it is contemplated that it could be at other angles. The driveshaft 44 and the drive mechanism transfer the power of the engine 36 to the propeller 20 mounted on the rear side of the gear case assembly 40 of the drive unit 12. It is contemplated that the propulsion system of the outboard engine 10 could alternatively include a jet propulsion device, turbine or other known propelling device. It is further contemplated that the bladed rotor could alternatively be an impeller.

To facilitate the installation of the outboard engine 10 on the watercraft, the outboard engine 10 is provided with a box 48. The box 48 is connected on top of the rotary actuator 26. As a result, the box 48 pivots about the tilt/trim axis 24 when the outboard engine 10 is tilted, but does not pivot about the steering axis 30 when the outboard engine 10 is steered. It is contemplated that the box 48 could be mounted elsewhere on the bracket assembly 14 or on the drive unit 12. Devices located inside the cowling 38 which need to be connected to other devices disposed externally of the outboard engine 10, such as on the deck or hull 18 of the watercraft, are provided with lines which extend inside the box 48. In one implementation, these lines are installed in and routed to the box 48 by the manufacturer of the outboard engine 10 during manufacturing of the outboard engine 10. Similarly, the corresponding devices disposed externally of the outboard engine 10 are also provided with lines that extend inside the box 48 where they are connected with their corresponding lines from the outboard engine 10. It is contemplated that one or more lines could be connected between one or more devices located inside the cowling 38 to one or more devices located externally of the outboard engine 10 and simply pass through the box 48. In such an implementation, the box 48 would reduce movement of the one or more lines when the outboard engine 10 is steered, tilted or trimmed.

Other known components of an engine assembly are included within the cowling 38, such as a starter motor, an alternator and the exhaust manifold. As it is believed that these components would be readily recognized by one of ordinary skill in the art, further explanation and description of these components will not be provided herein.

The bracket assembly 14 will now be described in more detail. The bracket assembly 14 includes a swivel bracket 50 pivotally connected to a stern bracket 52 via the rotary actuator 26. The stern bracket 52 includes a plurality of holes and slots (not shown) adapted to receive fasteners (not shown) used to fasten the bracket assembly 14 to the transom 16 of the watercraft. By providing many holes and slots, the vertical position of the stern bracket 52, and therefore the bracket assembly 14, relative to the transom 16 can be adjusted.

The rotary actuator 26 includes a cylindrical main body 54, a central shaft (not shown) disposed inside the main body 54 and protruding from the ends thereof, and a piston (not shown) surrounding the central shaft and disposed inside the main body 54. The main body 54 is located at an upper end of the swivel bracket 50 and is integrally formed therewith. It is contemplated that the main body 54 could be fastened, welded, or otherwise connected to the swivel bracket 50. The central shaft is coaxial with the tilt/trim axis 24. Splined disks (not shown) are provided over the portions of the central shaft that protrude from the main body 54. The splined disks are connected to the central shaft so as to be rotationally fixed relative to the central shaft. The stern bracket 52 has splined openings at the upper end thereof that receive the splined disks therein. As a result, the stern bracket 52, the splined disks and the central shaft are all rotationally fixed relative to each other. Anchoring end portions 56 are fastened to the sides of the stern bracket 52 over the splined openings thereof and the ends of the central shaft, thus preventing lateral displacement of the swivel bracket 50 relative to the stern bracket 52.

The piston is engaged to the central shaft via oblique spline teeth on the central shaft and matching splines on the inside diameter of the piston. The piston is slidably engaged to the inside wall of the cylindrical main body 54 via longitudinal spline teeth on the outer diameter of the piston and matching splines on the inside diameter of the main body 54. By applying pressure on the piston, by supplying hydraulic fluid inside the main body 54 on one side of the piston, the piston slides along the central shaft. Since the central shaft is rotationally fixed relative to the stern bracket 52, the oblique spline teeth cause the piston, and therefore the main body 54 (due to the longitudinal spline teeth), to pivot about the central shaft and the tilt/trim axis 24. The connection between the main body 54 and the swivel bracket 50 causes the swivel bracket 50 to pivot about the tilt/trim axis 24 together with the main body 54. Supplying hydraulic fluid to one side of the piston causes the swivel bracket 50 to pivot away from the stern bracket 52 (i.e. tilt up). Supplying hydraulic fluid to the other side of the piston causes the swivel bracket 50 to pivot toward the stern bracket 52 (i.e. tilt down).

U.S. Pat. No. 7,736,206 B1, issued Jun. 15, 2010, the entirety of which is incorporated herein by reference, provides additional details regarding rotary actuators similar in construction to the rotary actuator 26. It is contemplated that the rotary actuator 26 could be replaced by a linear hydraulic actuator connected between the swivel bracket 50 and the stern bracket 52.

The linear actuators 22 each include a cylinder 58, a piston (not shown) disposed inside the cylinder 58, a rod 60 connected to the piston and protruding from the cylinder 58 and a roller (not shown) connected to the end of the rod 60. As can be seen, the cylinders 58 are located at a lower end of the swivel bracket 50. The cylinders 58 are integrally formed with the swivel bracket 50 and the lines which supply them with hydraulic fluid are formed thereby. It is contemplated that the cylinders 58 could alternatively be fastened, welded, or otherwise connected to the swivel bracket 50. The rods 60 extend generally perpendicularly to the tilt/trim axis 24 and to the steering axis 30. It is contemplated that the hydraulic linear actuators 22 could be replaced by other types of linear actuators having a fixed portion connected to the swivel bracket 50 and a movable portion being extendable and retractable linearly relative to the fixed portion.

By supplying hydraulic fluid inside the cylinders 58 on the side of the pistons opposite the side from which the rods 60 extend, the pistons slide inside the cylinders 58. This causes the rods 60 to extend further from the cylinders 58 and the rollers to roll along and push against the curved surfaces formed by ramps (not shown) connected to the stern bracket 52. As a result, the swivel bracket 50 pivots away from the stern bracket 52 (i.e. trims up) about the tilt/trim axis 24 up to the angle shown in FIG. 2 where the rods 60 are fully extended. In one exemplary implementation, the swivel bracket 50 pivots by 22 degrees from its lowest position to the highest trim position shown in FIG. 2. It is contemplated that this angle could be between 15 and 30 degrees. Once this angle is reached, should further pivoting of the swivel bracket 50 relative to the stern bracket 52 (i.e. tilt) be desired, the rotary actuator 26 provides the pivoting motion. To pivot the swivel bracket 50 back toward the stern bracket 52 (i.e. trim down) about the tilt/trim axis 24 from the position shown in FIG. 2, the hydraulic fluid can be actively removed from the cylinders 58 (i.e. pumped out), or can be pushed out of the cylinders 58 by the pistons 60 due to the weight of the swivel bracket 50 and the drive unit 12 pushing toward the stern bracket 52. The movement achieved by the linear actuators 22 is known as trim as they allow for precise angular adjustment of the swivel bracket 50 relative to the stern bracket 52 at a slower angular speed than that provided by the rotary actuator 26.

Similarly to the rotary actuator 26, the rotary actuator 28 includes a cylindrical main body 62, a central shaft (not shown) disposed inside the main body 62 and protruding from the ends thereof and a piston (not shown) surrounding the central shaft and disposed inside the main body 62. The main body 62 is centrally located along the swivel bracket 50 and is integrally formed therewith. It is contemplated that the main body 62 could be fastened, welded, or otherwise connected to the swivel bracket 50. The central shaft is coaxial with the steering axis 30. Splined disks (not shown) are provided over the portions of the central shaft that protrude from the main body 62. The splined disks are connected to the central shaft so as to be rotationally fixed relative to the central shaft. An upper generally U-shaped drive unit mounting bracket 64 has a splined opening therein that receives the upper splined disk therein. Similarly, a lower generally U-shaped drive unit mounting bracket 66 has a splined opening therein that receives the lower splined disk therein. The upper and lower drive unit mounting brackets 64, 66 are fastened to the drive unit 12 so as to support the drive unit 12 onto the bracket assembly 14. As a result, the drive unit 12, the splined disks and the central shaft are all rotationally fixed relative to each other. Anchoring end portions (not shown) are fastened to the upper and lower drive unit mounting brackets 64, 66 over the splined openings thereof and the ends of the central shaft, thus preventing displacement of the drive unit 12 along the steering axis 30.

The piston is engaged to the central shaft via oblique spline teeth on the central shaft and matching splines on the inside diameter of the piston. The piston is slidably engaged to the inside wall of the cylindrical main body 62 via longitudinal spline teeth on the outer diameter of the piston and matching splines on the inside diameter of the main body 62. By applying pressure on the piston, by supplying hydraulic fluid inside the main body 62 on one side of the piston, the piston slides along the central shaft. Since the main body 62 is rotationally fixed relative to the swivel bracket 50, the oblique spline teeth cause the central shaft and therefore the upper and lower drive unit mounting bracket 64, 66, to pivot about the steering axis 30. The connections between the drive unit 12 and the upper and lower drive unit mounting brackets 64, 66 cause the drive unit 12 to pivot about the steering axis 30 together with the central shaft. Supplying hydraulic fluid to one side of the piston causes the drive unit 12 to steer left. Supplying hydraulic fluid to the other side of the piston causes the drive unit 12 to steer right.

U.S. Pat. No. 7,736,206 B1, issued Jun. 15, 2010, provides additional details regarding rotary actuators similar in construction to the rotary actuator 28. It is contemplated that the rotary actuator 28 could be replaced by a linear hydraulic actuator connected between the swivel bracket 50 and the drive unit 12.

To supply hydraulic fluid to the rotary actuators 26, 28 and the linear actuators 22, the bracket assembly 14 is provided with a hydraulic unit (not shown). The hydraulic unit is mounted to the swivel bracket 50 so as to pivot together with the swivel bracket 50 about the tilt-trim axis 24. It is contemplated that the hydraulic unit or some elements thereof could be mounted to the stern bracket 52, or be disposed in the watercraft instead.

The upper drive unit mounting bracket 64 has a forwardly extending arm 68. Two linkages 70 are pivotally fastened to the top of the arm 68. When more than one marine outboard engine is provided on the transom 16 of the watercraft, one or both of the linkages 70, depending on the position and number of marine outboard engines, of the marine outboard engine 10 are connected to rods which are connected at their other ends to corresponding linkages on the other marine outboard engines. Accordingly, when the marine outboard engine 10 is steered, the linkages 70 and rods cause the other marine outboard engines to be steered together with the marine outboard engine 10.

Figure 3:
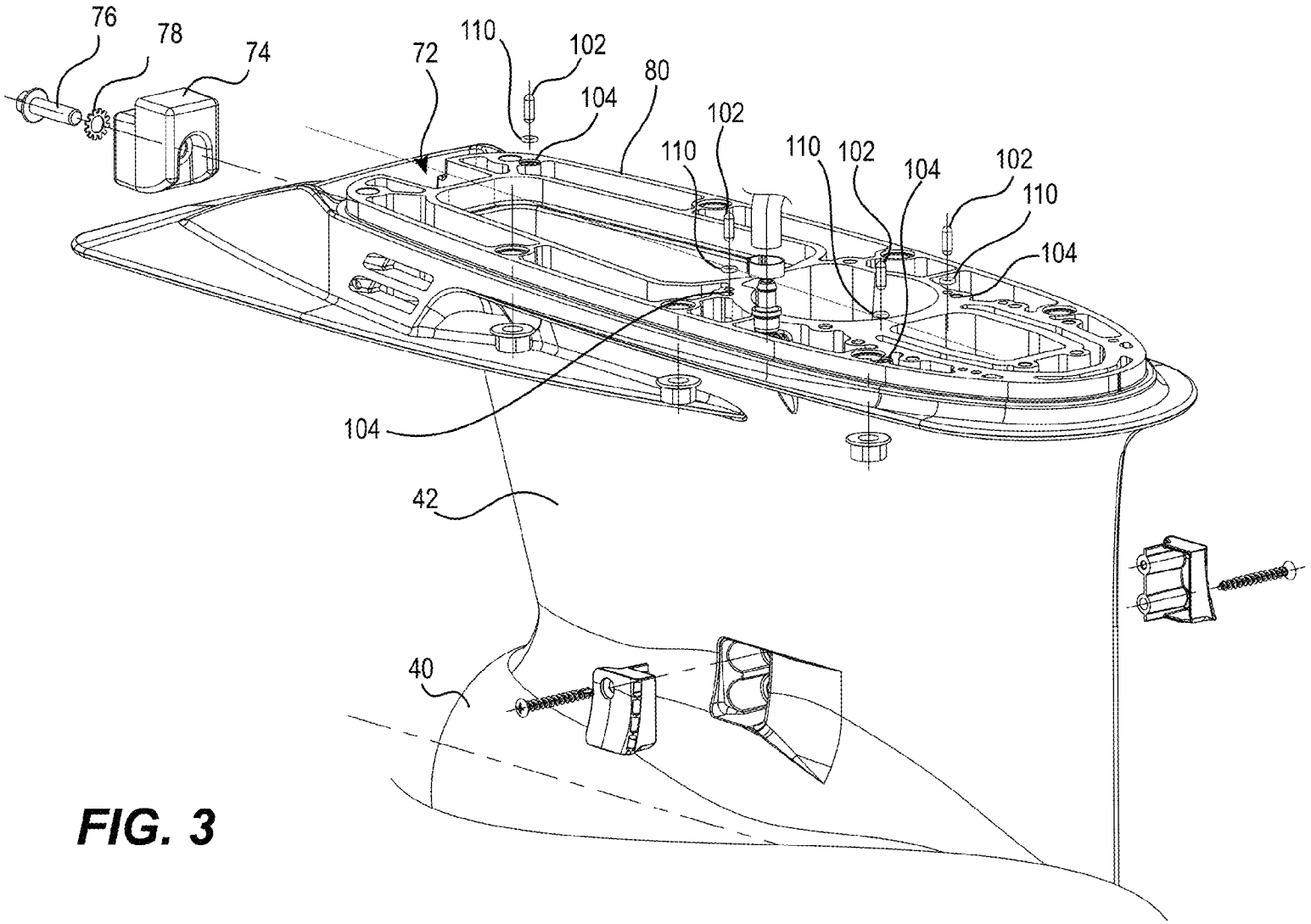
FIG. 3 is an exploded perspective view taken from a front, right side of a portion of a gear case assembly of the marine outboard engine of FIG. 1.

As can be seen in FIG. 3, the gear case housing 42 forms a recess 72 on a rear upper part thereof. A sacrificial anode 74 is received in the recess 72 and is connected to the gear case housing 42 by a bolt 76. An external star washer 78 is disposed around the bolt 76 between the head of bolt 76 and the anode 74. As a result, the anode 74 is conductively connected to the gear case housing 42 and gear case assembly 40, which are integrally formed. The recess 72 and the shape of the anode 74 help in having the anode 74 visually blend in with the rest of the gear case assembly 40.

In the present implementation, the anode 74 is made of an aluminum-indium alloy and the gear case housing 42 is made of aluminum. It is contemplated that the gear case housing 42 could be made of another metal such as steel. It is also contemplated that the anode 74 could be made of a material other than aluminum, as long as the electrochemical potential of the anode material is more negative than the electrochemical potential of the metal of which the gear case housing 42 is made of. Since the anode 74 has a more negative electrochemical potential than the aluminum gear case housing 42, the anode 74 will corrode instead of the gear case housing 42. Once the anode 74 becomes too corroded, it is removed and replaced with another anode 74. Other parts of the outboard engine 10 are similarly provided with an anode mounted and conductively connected thereto.

In addition to the anode 74, in order to further protect the gear case assembly 40 from corrosion, the surfaces of the gear case assembly 40 that are going to be exposed to water during use are provided with a corrosion resistant surface treatment. In the present implementation, the corrosion resistant surface treatment consists of ceramic coating, such as Alodine® EC$^{2}$™ electroceramic coating, applied to the aluminum surfaces, a base coat of non-conductive paint applied on top of the ceramic coating and a top coat of non-conductive paint applied on top of the base coat. It is contemplated that only one or more than two coats of non-conductive paint could be applied. It is also contemplated that only one of the ceramic coating and the non-conductive paint could be applied. It is also contemplated that the ceramic coating could be replaced by another surface treatment such as a non-electrodeposited ceramic coating, galvanization and conversion coating. Examples of conversion coating include anodization and chromate conversion coating. As would be understood, depending on the type of metal being used to make the gear case housing 42 and the intended operating conditions (i.e. salt versus fresh water, operating temperature, etc.), some types of surface treatments may be more suitable than others. As the outer surfaces of the gear case assembly 40 are apparent to a person looking at the outboard engine 10, they can additionally be provided with a coat of marine gloss paint on top of the top coat of non-conductive paint and then a clear coat on top of the marine gloss paint.

Surfaces of metallic parts of the outboard engine 10 that are going to be exposed to water during use, such as the cylinder head 36C, the cylinder block 36B, the crankcase 36A, the exhaust housing 43 and the bracket assembly 14, are provided with a corrosion resistant surface treatment similar to the gear case assembly 40 described above.

Some metallic parts of the outboard engine 10 are not provided with an anode. This is the case of the exhaust housing 43 in the present implementation. Although the exhaust housing 43 is not exposed to water from the body of water splashing during use of the outboard engine 10, water from the body of water is caused to flow through the exhaust housing 43 for cooling purposes. The exhaust housing 43 is provided with a corrosion resistant surface treatment, but needs to be conductively connected to an anode to benefit from additional corrosion resistance. The lower edge of the exhaust housing 43 is in contact with the upper edge 80 (FIG. 3) of the gear case housing 42 but the surface treatments applied to both parts prevents a conductive connection from being established between the two parts.

To establish a conductive connection between the exhaust housing 43 and the gear case housing 42, the exhaust housing 43 and the gear case housing 42 are assembled as in the assembly 100 described in greater detail below. In such an assembly, a conductive member 102, in the present implementation a metallic pin 102, is inserted into a hole 104 in the top edge 80 of the gear case housing 42 and into a corresponding hole 108 (FIG. 4) in the bottom edge of the exhaust housing 43. The internal surfaces of the holes are free of corrosion resistant surface treatment, as such the pin 102 conductively connects the exhaust housing 43 to the gear case housing 42. Therefore, due to its conductive connection to the gear case housing 42, the exhaust housing 43 is also conductively connected to the anode 74, which will help prevent the exhaust housing 43 from corroding. As can be seen in FIG. 3, four pins 102 are used to conductively connect the gear case housing 42 with the exhaust housing 43. It is contemplated that one, two, three or more than four pins 102 could be used.

It is contemplated that any two or more adjacent metallic part of the outboard engine 10, at least one of which has an anode mounted and conductively connected to it, could be conductively connected via one or more pins 102 as in the corrosion prevention assembly 100 described below. For example one or more pins 102 could conductively connect the cylinder head 36C to the cylinder block 36B; the cylinder block 36B to the crankcase 36A; then engine 36 to the exhaust housing 43; and the hydraulic unit to the swivel bracket 50.

Turning now to FIGS. 4 to 8, the corrosion prevention assembly 100 and alternative implementations thereof will be described. In each of these implementations, a metallic part 120 is in contact with and is conductively connected to another metallic part 122. It is contemplated that the metallic parts 120, 122 could be any two adjacent metallic parts of the outboard engine 10 described above that require corrosion protection. Also, in each of these implementations, an anode 124 is mounted and conductively connected to one of the two parts 120, 122 in a manner similar to the anode 74 described above or any other suitable manner. The anode 124 corresponds to the anode 74 in an implementation where one of the two parts 120, 122 is the gear case housing 42. Also, in each of these implementations, the metallic parts 120, 122 each have a corrosion resistant surface treatment at least on their surfaces that could be exposed to water and have at least one surface that is free of corrosion resistant surface treatment, and is therefore bare metal. The corrosion resistant surface treatment corresponds to any corrosion resistant surface treatment, including those previously described. For simplicity, in the implementations described below, surfaces that are free of corrosion resistant surface treatment have been labelled with a B and surfaces having a corrosion resistant surface treatment have been labelled with a C.

Figure 4:
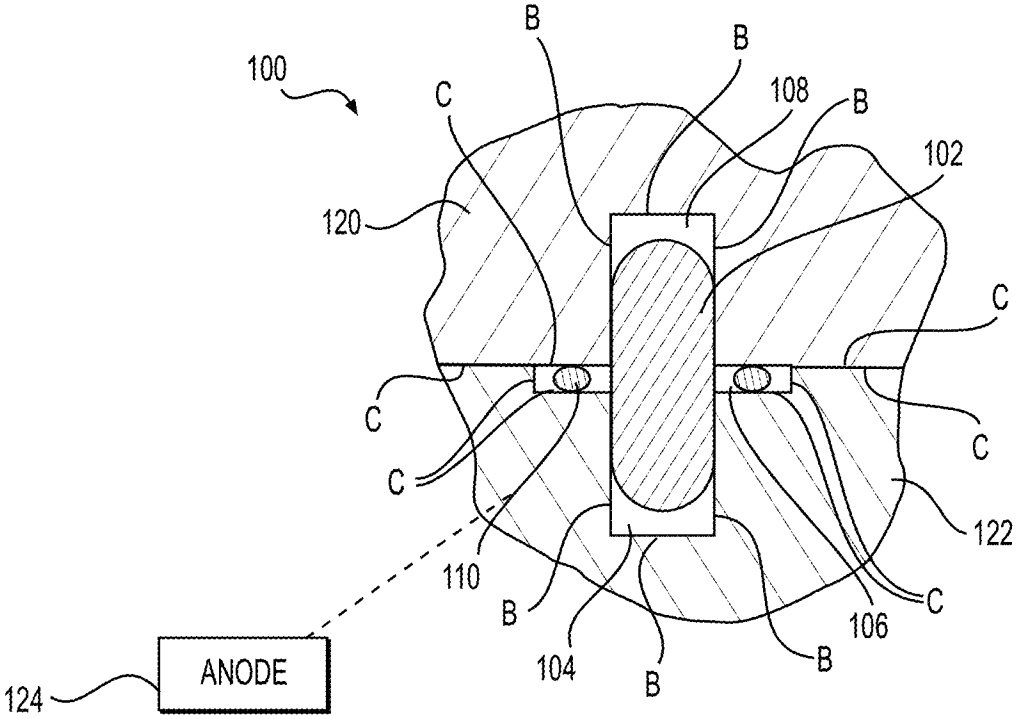
FIG. 4 is a cross-sectional view of a corrosion prevention assembly of the outboard engine of FIG. 1.

The corrosion resistant assembly 100 will now be described with respect to FIG. 4. As is schematically illustrated, in the assembly 100, the anode 124 is mounted and conductively connected to the part 122. The part 122 defines a recess consisting of the hole 104 and a counterbore 106 enlarging the opened end of the hole 104. The hole 104 is a cylindrical hole having a closed end. The part 120 defines a recess consisting of a hole 108. The hole 108 is a cylindrical hole having a closed end. The hole 108 is aligned with the hole 104. A conductive member 102 in the form of the metallic pin 102 is received in both holes 104, 108. In the present implementation, the pin 102 is press-fit inside the holes 104, 108. It is contemplated that the pin 102 could be hollow. A sealing member 110, in the present implementation an O-ring 110, is disposed around the pin 102 in the counterbore 106. It is contemplated that the O-ring 110 could be sized so as to fit snugly around the pin 102. When the two parts 120, 122 are fastened to each other, by bolts or other means, the O-ring 110 is squeezed between the two parts 120, 122 and, as a result, prevents water from entering the holes 104, 108. As can be seen, the surfaces of the holes 104, 108 are free of corrosion resistant surface treatment, as such the pin 102 is in contact with the metal of both parts 120, 122 and establishes a conductive connection between the two parts 120, 122. Therefore, the part 120 is conductively connected to the anode 124 by the pin 102 and the part 122. It is contemplated that, since the pin 102 does not touch the closed ends of the holes 104, 108, that the closed ends of the holes 104, 108 could be provided with a corrosion resistant surface treatment. It is also contemplated that the surfaces of the holes 104, 108 could be provided with a corrosion resistant surface treatment except for a portion thereof on the lateral side of each hole 104, 108 that would be in contact with the pin 102 and sufficient to provide a conductive connection. It is also contemplated that the hole 108 in the part 120 could be omitted, in which case the pin 102 would be shorter and an end of the pin 102 would contact a surface of the part 120 disposed within the perimeter of the O-ring 110 that is free of corrosion resistant surface treatment. The counterbore 106 has a lateral side that is concentric with the lateral side of the hole 104, and a flat surface adjacent the hole 104 that is substantially parallel to the surfaces of parts 120 and 122 that are protected with a corrosion resistant surface treatment, although it is contemplated that the counterbore 106 could have any of a variety of shapes that enable retention of the O-ring 110. It is contemplated that the counterbore 106 could be formed in part 120, rather than part 122. It is also contemplated that the part 120 could have a counterbore enlarging the open end of the hole 108 opposite the counterbore 106 in part 122, in which case the diameter of the O-ring 110 would need to be bigger to make contact with both parts 120, 122.

Figure 5:
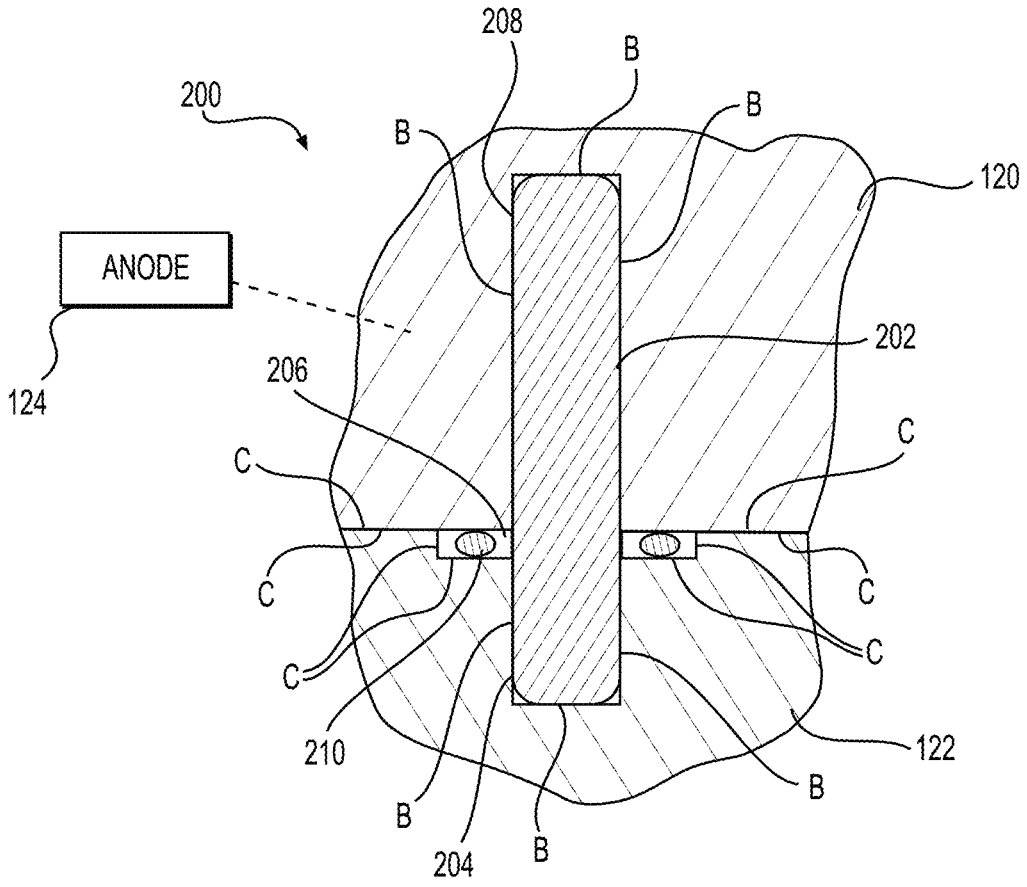
FIG. 5 is a cross-sectional view of an alternative implementation of the assembly of FIG. 4.

A corrosion resistant assembly 200 will now be described with respect to FIG. 5. As is schematically illustrated, in the assembly 200, the anode 124 is mounted and conductively connected to the part 120. The part 122 defines a recess consisting of a hole 204 and a counterbore 206 enlarging the opened end of the hole 204. The hole 204 is a cylindrical hole having a closed end. The part 120 defines a recess consisting of a hole 208. The hole 208 is a cylindrical hole having a closed end. The hole 208 is aligned with the hole 204. A conductive member in the form of a metallic pin 202 is received in both holes 204, 208. In the present implementation, the pin 202 is press-fit inside the holes 204, 208. It is contemplated that the pin 202 could be hollow. An O-ring 210 is disposed around the pin 202 in the counterbore 206. When the two parts 120, 122 are fastened to each other, by bolts or other means, the O-ring 210 is squeezed between the two parts 120, 122 and, as a result, prevents water from entering the holes 204, 208. As can be seen, the surfaces of the holes 204, 208 are free of corrosion resistant surface treatment, as such the pin 202 is in contact with the metal of both parts 120, 122 and establishes a conductive connection between the two parts 120, 122. Therefore, the part 122 is conductively connected to the anode 124 by the pin 202 and the part 120. It is contemplated that, since the pin 202 touches the closed ends and the sides of the holes 204, 208, that either the closed ends or the sides of the holes 204, 208 could be provided with a corrosion resistant surface treatment. It is also contemplated that the surfaces of the holes 204, 208 could be provided with a corrosion resistant surface treatment except for a portion thereof on the closed end or the side of each hole 204, 208 that would be in contact with the pin 202 and sufficient to provide a conductive connection. It is also contemplated that the hole 208 in the part 120 could be omitted, in which case the pin 202 would be shorter and an end of the pin 202 would contact a surface of the part 120 disposed within the perimeter of the O-ring 210 that is free of corrosion resistant surface treatment. It is contemplated that the counterbore 206 could be formed in part 120, rather than part 122. It is also contemplated that the part 120 could have a counterbore enlarging the open end of the hole 208 opposite the counterbore 206 in part 122, in which case the diameter of the O-ring 210 would need to be bigger to make contact with both parts 120, 122.

Figure 6:
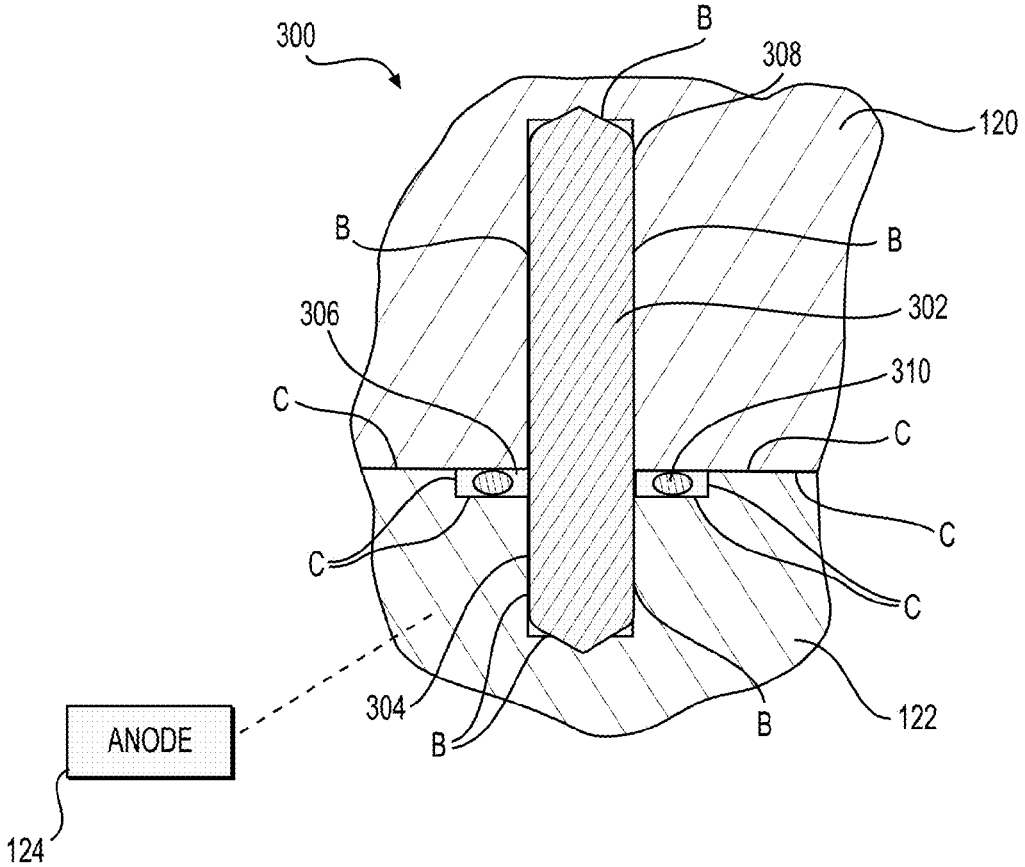
FIG. 6 is a cross-sectional view of another alternative implementation of the assembly of FIG. 4.

A corrosion resistant assembly 300 will now be described with respect to FIG. 6. As is schematically illustrated, in the assembly 300, the anode 124 is mounted and conductively connected to the part 122. The part 122 defines a recess consisting of a hole 304 and a counterbore 306 enlarging the opened end of the hole 304. The hole 304 is a cylindrical hole having a closed end. The part 120 defines a recess consisting of a hole 308. The hole 308 is a cylindrical hole having a closed end. The hole 308 is aligned with the hole 304. A conductive member in the form of a metallic pin 302 is received in both holes 304, 308. In the present implementation, the pin 302 is not press-fit inside the holes 304, 308. The pin 302 is longer than initial distance between the closed ends of the holes 304, 308 and pointed at each extremity. As such, when the parts 120, 122 are fastened to each other, the ends of the pin 302 dig into the metal of the parts 120, 122 as shown in FIG. 6, thus ensuring a good metal-to-metal contact. An O-ring 310 is disposed around the pin 302 in the counterbore 306. When the two parts 120, 122 are fastened to each other, by bolts or other means, the O-ring 310 is squeezed between the two parts 120, 122 and, as a result, prevents water from entering the holes 304, 308. As can be seen, the surfaces of the holes 304, 308 are free of corrosion resistant surface treatment, as such the pin 302 is in contact with the metal of both parts 120, 122 and establishes a conductive connection between the two parts 120, 122. Therefore, the part 120 is conductively connected to the anode 124 by the pin 302 and the part 122. It is contemplated that, since the pin 302 touches the closed ends and the sides of the holes 304, 308, that either the closed ends or the sides of the holes 304, 308 could be provided with a corrosion resistant surface treatment. It is also contemplated that the hole 308 in the part 120 could be omitted, in which case the pin 302 would be shorter and an end of the pin 302 would contact a surface of the part 120 disposed within the perimeter of the O-ring 310 that is free of corrosion resistant surface treatment. It is contemplated that the counterbore 306 could be formed in part 120, rather than part 122. It is also contemplated that the part 120 could have a counterbore enlarging the open end of the hole 308 opposite the counterbore 306 in part 122, in which case the diameter of the O-ring 310 would need to be bigger to make contact with both parts 120, 122.

Figure 7:
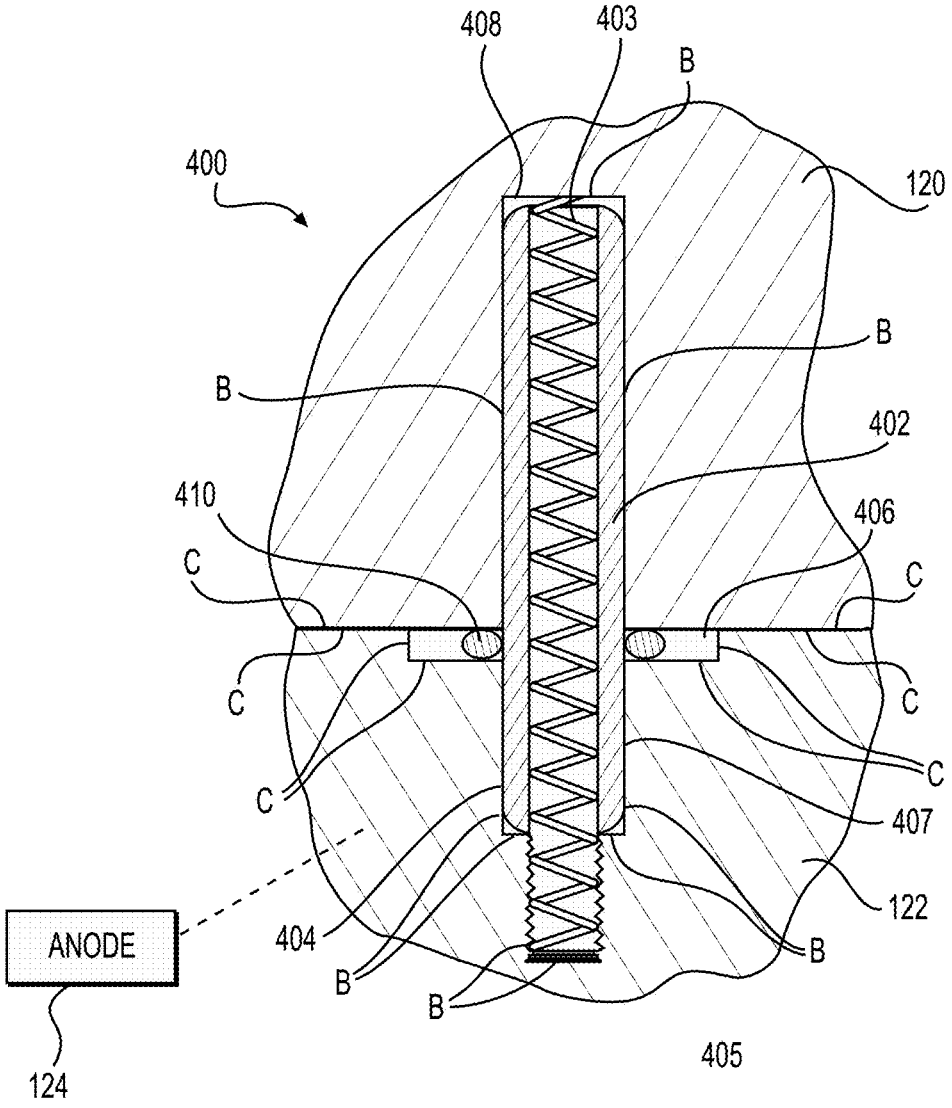
FIG. 7 is a cross-sectional view of another alternative implementation of the assembly of FIG. 4.

A corrosion resistant assembly 400 will now be described with respect to FIG. 7. As is schematically illustrated, in the assembly 400, the anode 124 is mounted and conductively connected to the part 122. The part 122 defines a recess consisting of a hole 404 and a counterbore 406 enlarging the opened end of the hole 404. The hole 404 has a cylindrical threaded portion 405 adjacent its closed end and a cylindrical non-threaded portion 407 between the portion 405 and its open end. As can be seen, the portion 407 has a larger diameter than the portion 405. The part 120 defines a recess consisting of a hole 408. The hole 408 is a cylindrical hole having a closed end. The hole 408 is aligned with the hole 404. A conductive member in the form of a hollow metallic pin 402 and a metallic spring 403 disposed inside the pin 402 is received in both holes 404, 408. In the present implementation, the pin 402 is press-fit inside the portion 407 of the hole 404 and inside the hole 408. The spring 403 has a portion engaging the threaded portion 405 so as to be retained by the threaded portion 405. The spring 403 is biased against the closed ends of the holes 404, 408. An O-ring 410 is disposed around the pin 402 in the counterbore 406. When the two parts 120, 122 are fastened to each other, by bolts or other means, the O-ring 410 is squeezed between the two parts 120, 122 and, as a result, prevents water from entering the holes 404, 408. As can be seen, the surfaces of the holes 404, 408 are free of corrosion resistant surface treatment, as such the pin 402 and the spring 403 are in contact with the metal of both parts 120, 122 and establish a conductive connection between the two parts 120, 122. Therefore, the part 120 is conductively connected to the anode 124 by the pin 402, the spring 403 and the part 122. It is contemplated that, since the spring 403 touches the closed ends of the holes 404, 408 and the side of the threaded portion 405, that the portion 407 of the hole 404 and the side of the hole 408 could be provided with a corrosion resistant surface treatment. It is also contemplated that the surfaces of the holes 404, 408 could be provided with a corrosion resistant surface treatment except for portions thereof on the closed end or the side of each hole 404, 408 that would be in contact with the pin 402 and the spring 403. It is also contemplated that the hole 408 in the part 120 could be omitted, in which case the pin 402 and the spring 403 would be shorter and an end of the spring 403 would contact a surface of the part 120 disposed within the perimeter of the O-ring 410 that is free of corrosion resistant surface treatment. It is contemplated that the counterbore 406 could be formed in part 120, rather than part 122. It is also contemplated that the part 120 could have a counterbore enlarging the open end of the hole 408 opposite the counterbore 406 in part 122, in which case the diameter of the O-ring 410 would need to be bigger to make contact with both parts 120, 122. It is also contemplated that the hole 408 could have a threaded portion similar to the portion 405.

Figure 8:
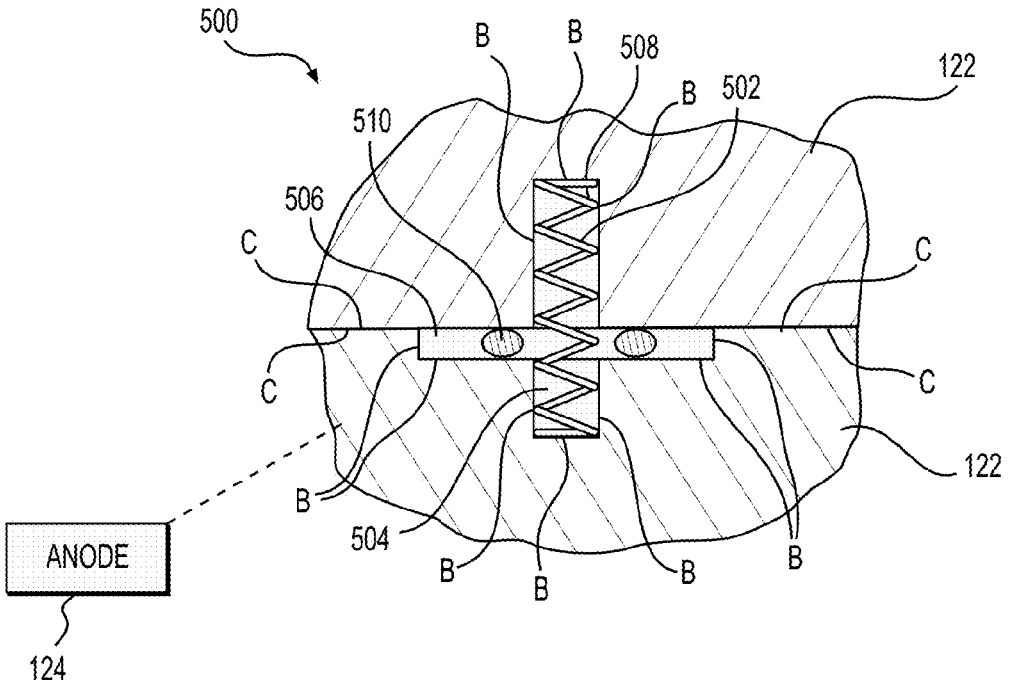
FIG. 8 is a cross-sectional view of another alternative implementation of the assembly of FIG. 4.

A corrosion resistant assembly 500 will now be described with respect to FIG. 8. As is schematically illustrated, in the assembly 500, the anode 124 is mounted and conductively connected to the part 122. The part 122 defines a recess consisting of a hole 504 and a counterbore 506 enlarging the opened end of the hole 504. The hole 504 is a cylindrical hole having a closed end. The part 120 defines a recess consisting of a hole 508. The hole 508 is a cylindrical hole having a closed end. The hole 508 is aligned with the hole 504. A conductive member in the form of a metallic spring 502 is received in both holes 504, 508. In the present implementation, the spring 502 is biased against the closed ends of the holes 504, 508. An O-ring 510 is disposed around the spring 502 in the counterbore 506. When the two parts 120, 122 are fastened to each other, by bolts or other means, the O-ring 510 is squeezed between the two parts 120, 122 and, as a result, prevents water from entering the holes 504, 508. As can be seen, the surfaces of the holes 504, 508 are free of corrosion resistant surface treatment, as such the spring 502 is in contact with the metal of both parts 120, 122 and establishes a conductive connection between the two parts 120, 122. Therefore, the part 120 is conductively connected to the anode 124 by the spring 502 and the part 122. It is contemplated that, since the spring 502 touches the closed ends of the holes 504, 508, that the sides of the holes 504, 508 could be provided with a corrosion resistant surface treatment. It is also contemplated that the surfaces of the holes 504, 508 could be provided with a corrosion resistant surface treatment except for a portion thereof on the closed end of each hole 504, 508 that would be in contact with the spring 502. It is also contemplated that the hole 508 in the part 120 could be omitted, in which case the spring 502 would be shorter and an end of the spring 502 would contact a surface of the part 120 disposed within the perimeter of the O-ring 510 that is free of corrosion resistant surface treatment. It is contemplated that the counterbore 506 could be formed in part 120, rather than part 122. It is also contemplated that the part 120 could have a counterbore enlarging the open end of the hole 508 opposite the counterbore 506 in part 122, in which case the diameter of the O-ring 510 would need to be bigger to make contact with both parts 120, 122. It is also contemplated that one or both holes 504, 508 could have a threaded portion to engage the spring 502.

In the above implementations, the O-rings 110, 210, 310, 410 and 510 are made of rubber. It is contemplated that the O-rings 110, 210, 310, 410 and 510 could be made of a conductive material in which case the surfaces of the parts 120, 122 that they contact should be free of corrosion resistant material. It is also contemplated that the O-rings 110, 210, 310, 410 and 510 could be replaced by another type of sealing member, such as a flat gasket or caulk for example.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. An assembly of parts comprising:

a first metal part having a first surface having a corrosion resistant surface treatment and a second surface being free of corrosion resistant surface treatment;

a second metal part having a third surface having a corrosion resistant surface treatment and a fourth surface being free of corrosion resistant surface treatment, the second metal part defining a recess, the fourth surface being a surface defined by the recess, the first surface being in direct physical contact with the third surface;

a conductive member disposed at least in part in the recess between the first and second metal parts, the conductive member being in direct physical contact with the second and fourth surfaces and forming a conductive connection between the first and second metal parts;

a sealing member disposed in the recess around the conductive member, the sealing member being in direct physical contact with the first and second metal parts; and a sacrificial anode mounted and conductively connected to one of the first and second metal parts, the sacrificial anode being conductively connected to another one of the first and second metal parts by the one of the first and second metal parts and the conductive member.

2. The assembly of claim 1, wherein the corrosion resistant surface treatment of the first metal part and the corrosion resistant surface treatment of the second metal part each include at least one of conversion coating, ceramic coating and non-conductive paint.

3. The assembly of claim 2, wherein the corrosion resistant surface treatment of the first metal part and the corrosion resistant surface treatment of the second metal part each include conversion coating; and wherein the conversion coating includes one of anodization and chromate conversion coating.

4. The assembly of claim 2, wherein the corrosion resistant surface treatment of the first metal part and the corrosion resistant surface treatment of the second metal part each include non-conductive paint disposed on top of another surface treatment, the other surface treatment being at least one of conversion coating and ceramic coating.

5. The assembly of claim 1, wherein:

the recess includes a hole and a counterbore, the hole having a closed end;

the conductive member is disposed at least in part in the hole;

the fourth surface is a surface defined by the hole; and the sealing member is disposed in the counterbore.

6. The assembly of claim 5, wherein the sacrificial anode is mounted and conductively connected to the second metal part.

7. The assembly of claim 5, wherein:

the hole is a second hole;

the first metal part defines a first hole having a closed end;

the first hole is aligned with the second hole;

the conductive member is disposed at least in part in the first hole; and the second surface is a surface defined by the first hole.

8. The assembly of claim 7, wherein the conductive member includes a pin.

9. The assembly of claim 8, wherein the sealing member is an O-ring.

10. The assembly of claim 8, wherein:

the pin is hollow;

the conductive member further includes a spring disposed inside the pin; and the spring contacts the second and fourth surfaces.

11. The assembly of claim 10, wherein:

one of the first and second holes has a threaded portion adjacent the closed end of the one of the first and second holes; and the spring engages the threaded portion.

12. The assembly of claim 8, wherein the pin is press-fit in the first and second holes.

13. The assembly of claim 7, wherein the conductive member is a spring.

14. The assembly of claim 5, wherein the conductive member includes a pin.

15. The assembly of claim 1, wherein the conductive member includes a pin.

16. The assembly of claim 1, wherein the sealing member is an O-ring.

17. The assembly of claim 1, wherein the first and second metal parts are two adjacent metal parts of a drive unit of a marine outboard engine.

18. The assembly of claim 17, wherein the two adjacent metal parts are two of a cylinder head, a cylinder block, a crankcase, an exhaust housing and a gear case assembly.

19. The assembly of claim 18, wherein the two adjacent metal parts are the exhaust housing and the gear case assembly.

20. The assembly of claim 19, wherein the first metal part is the exhaust housing, the second metal part is the gear case assembly and the sacrificial anode is mounted to and conductively connected to the gear case assembly.

* * * * *